US011219300B2

(12) United States Patent
Gowen

(10) Patent No.: US 11,219,300 B2
(45) Date of Patent: Jan. 11, 2022

(54) MULTI-SURFACE CLEANING BRUSH

(71) Applicant: Willard Gowen, Bellingham, WA (US)

(72) Inventor: Willard Gowen, Bellingham, WA (US)

( * ) Notice: Subject to any disclaimer, the term of this patent is extended or adjusted under 35 U.S.C. 154(b) by 40 days.

(21) Appl. No.: 16/901,081

(22) Filed: Jun. 15, 2020

(65) Prior Publication Data

US 2020/0390226 A1 Dec. 17, 2020

Related U.S. Application Data

(60) Provisional application No. 62/862,068, filed on Jun. 15, 2019.

(51) Int. Cl.
*A46B 9/02* (2006.01)
*A46D 1/00* (2006.01)

(52) U.S. Cl.
CPC ..... *A46B 9/028* (2013.01); *A46B 9/02* (2013.01); *A46B 9/025* (2013.01); *A46B 9/026* (2013.01); *A46B 2200/3033* (2013.01); *A46B 2200/3046* (2013.01); *A46D 1/0207* (2013.01)

(58) Field of Classification Search
CPC ..... A46B 5/0008; A46B 5/0012; A46B 9/00; A46B 9/02; A46B 9/025; A46B 9/026; A46B 9/028
USPC ..... 15/106, 159.1, 160, 164; D4/127, 128, D4/130, 132, 133
See application file for complete search history.

(56) References Cited

U.S. PATENT DOCUMENTS 1,813,076 A * 7/1931 Newell ..... A46B 9/04 15/167.1
1,893,002 A * 1/1933 Rothschild ..... A46B 5/026 15/167.1
D181,055 S * 9/1957 Hutcheson ..... D4/128
4,888,844 A * 12/1989 Maggs ..... A46B 9/04 15/106
D364,506 S * 11/1995 Cousins ..... D4/118
6,148,466 A * 11/2000 Smitelli, III ..... A46B 9/02 15/1.7

(Continued)

FOREIGN PATENT DOCUMENTS

GB 2265822 * 10/1993
JP 1-185202 * 7/1989
JP 2001-61554 * 3/2001

*Primary Examiner* — Mark Spisich
(74) *Attorney, Agent, or Firm* — PatentFile, LLC; Bradley C. Fach; Steven R. Kick

(57) ABSTRACT

A multi-surface cleaning brush may include: a head portion, an optional handle, and an optional tail portion. The head portion may include a head and a hemi-spheroid region formed by a first plurality of bristles coupled to the head in which the first plurality of bristles may terminate distally from the head to form a substantially hemi-spheroid shape. The head portion and tail portion may be coupled to opposing ends of the handle. Preferably, the first plurality of bristles may comprise microfiber. Preferably, the brush may also include a radial region formed by a second plurality of bristles which may terminate distally from the head to form a substantially cylindrical shape, and the radial region may be positioned between the hemi-spheroid region and the optional handle. An optional handle may be configured as an ergonomically shaped hand grip so that the user's hand may grip the brush via the handle.

6 Claims, 2 Drawing Sheets

(56) References Cited

U.S. PATENT DOCUMENTS

| | | | | |
|---|---|---|---|---|
| 6,308,364 | B1 * | 10/2001 | Arone | A46B 9/04 15/106 |
| D460,270 | S * | 7/2002 | Mannisto, Jr. | D4/106 |
| D579,211 | S * | 10/2008 | Libman | D4/133 |
| D647,703 | S * | 11/2011 | Li | D4/128 |
| 2004/0117933 | A1 * | 6/2004 | Tubman | A46B 5/00 15/160 |
| 2004/0237233 | A1 * | 12/2004 | Dragan | A46B 3/02 15/104.94 |
| 2008/0109979 | A1 * | 5/2008 | Jo | A46B 9/026 15/167.1 |
| 2011/0277257 | A1 * | 11/2011 | Chapman | A46B 5/02 15/207.2 |
| 2015/0135456 | A1 * | 5/2015 | Kirchhofer | B29C 45/1676 15/160 |

* cited by examiner

MULTI-SURFACE CLEANING BRUSH

CROSS REFERENCE TO RELATED APPLICATIONS

This application claims priority to and the benefit of the filing date of U.S. Provisional Application No. 62/862,068, filed on Jun. 15, 2019, entitled "DRY AND WET MULTI-SURFACE ROTARY CLEANING BRUSH FOR AUTOMOBILE", which is hereby incorporated by reference in its entirety.

FIELD OF THE INVENTION

This patent specification relates to the field of devices and apparatuses used in cleaning surfaces and objects. More specifically, this patent specification relates to a multi-surface cleaning brush for surfaces and objects, such as which may be found, but not limited on an automobile.

BACKGROUND

Cleaning brushes are needed for different cleaning application. Conventional cleaning brushes in automobile are used for surface cleaning. Different types of cleaning brushes are used for wet cleaning. The cleaning brushes cleans dirt and dust from the surface.

A number of different types of apparatus and devices for cleaning automobile surface are available in prior art. For example, the following patents are provided for their supportive teachings and are all incorporated by reference:

Prior art document, US20110197917A1 discloses a cleaning apparatus which have a cover which may be affixed to an apparatus head or removable or a combination of removable and fixed covering. A portion of the apparatus is hollow and may be used as a product dispenser to retain and dispense various flow able solutions. Certain embodiments feature a scrubbing surface to aid in removing debris. Other embodiments teach a cleaning head of varying size and shape to permit navigation of small or select areas. Further embodiments disclose various cleaning, drying, and polishing surfaces such as brushes, sponges, microfiber, abrasive surfaces, melamine, and tacky surfaces. A variety of reversible and permanent affixation methods are disclosed.

In addition, prior art document, EP3165127A2 provides a cleaning brush which has arranged at a first lower end connection pins for gripping in the chuck of a machine with rotating drive shaft for rotation of the cleaning brush about its longitudinal axis. The cleaning brush has arranged at a second upper end rounded bristle carrier having on its lateral surface which are arranged distributed holes, in each of which a plurality of bristles existing bristle bundles are attached. The bristles are of at least two adjacent along the longitudinal axis arranged bristle bundles in the direction of the longitudinal axis is formed bent such that the bristles of the closer to the connecting pin arranged first bristle bundle at least partly the bristles of the further second bristle bundle.

In addition, prior art document, EP2517603A2 discloses a washing element which has a material with ordered or disordered micro fibers and combined with chemical-resistant and flexible material. The flexible material is arranged as filling material between the micro fibers for cross linking and stabilizing the micro fibers such that interstices store washing liquid. The filling material closes the interstices between the micro fibers such that water absorbing capacity of the washing element is between and weight per percent concerning to dead weight of the dry washing element. An independent claim is also included for a washing mat comprising a washing element.

Finally prior art document, DE202018103126U1 discloses a cleaning brush unit which is arranged for rotary cleaning movement, arranged with a arranged at a first end of the cleaning brush unit connecting pin for clamping in a machine with a rotating drive shaft for rotation of the cleaning brush unit about its longitudinal axis, and with a rotationally fixed the bristle carrier connected to the connecting pin with attachment points distributed at least over the lateral surface of the bristle carrier, in each of which a single bristle or in each case a bundle of bristles consisting of a plurality of bristles is fastened; characterized in that in the circumferential direction adjacent bristles or bristle bundles of adjacent attachment points have such different radial lengths.

However, above mentioned references and many other similar references has one or more of the following shortcomings: (a) Used only for either dry or wet cleaning (b) bulky or heavy; (c) short handle and (d) can't clean to tough corner or cutting edge.

Therefore, a need exists for novel cleaning brushes which are able to solve the above-mentioned concerns and shortcomings (and other similar concerns/shortcomings) of existing devices and apparatuses.

BRIEF SUMMARY OF THE INVENTION

A multi-surface cleaning brush is provided. In some embodiments, the brush may include a head portion that may include a head and a hemi-spheroid region formed by a first plurality of bristles coupled to the head in which the first plurality of bristles may terminate distally from the head to form a substantially hemi-spheroid shape. Optionally, the brush may include a handle and a tail portion. The head portion and an optional tail portion may be coupled to opposing ends of the optional handle. The brush may include a hand grip and optional receiver to accept extended handle for hard to reach areas.

In further embodiments, the first plurality of bristles may comprise microfiber.

In further embodiments, the hemi-spheroid region may have between a 6 to 8 inch radius.

In further embodiments, the head portion may include a radial region formed by a second plurality of bristles which may terminate distally from the head to form a substantially cylindrical shape, and the radial region may be positioned between the hemi-spheroid region and the handle.

In further embodiments, the radial region may have between a 6 to 8 inch radius.

It is an aspect of the present invention is to provide a multi-surface rotary cleaning brush for objects, such as automobiles, and all types of vehicles. Optionally, the ultra-absorbent microfiber bristles may be coupled to the head through multiple pores.

Another aspect of the present invention is to provide a brush for cleaning multiple parts of an automobile using ultra-absorbent microfiber without creating any scratch and damage to the surface. The ultra-absorbent microfiber bristles are soft which gives deep cleaning of the various vehicle surfaces.

Still another aspect of the present invention is to provide a brush for cleaning every part of the automobile, including hard to penetrate areas (tight in dimension), such as wheel, bumper grill, window, and in between parts of the vehicle.

Another aspect of the present invention is to provide a brush that may be used for different vehicle, such as car, truck, motorbike, SUVs, RVs boats and other available type vehicle.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
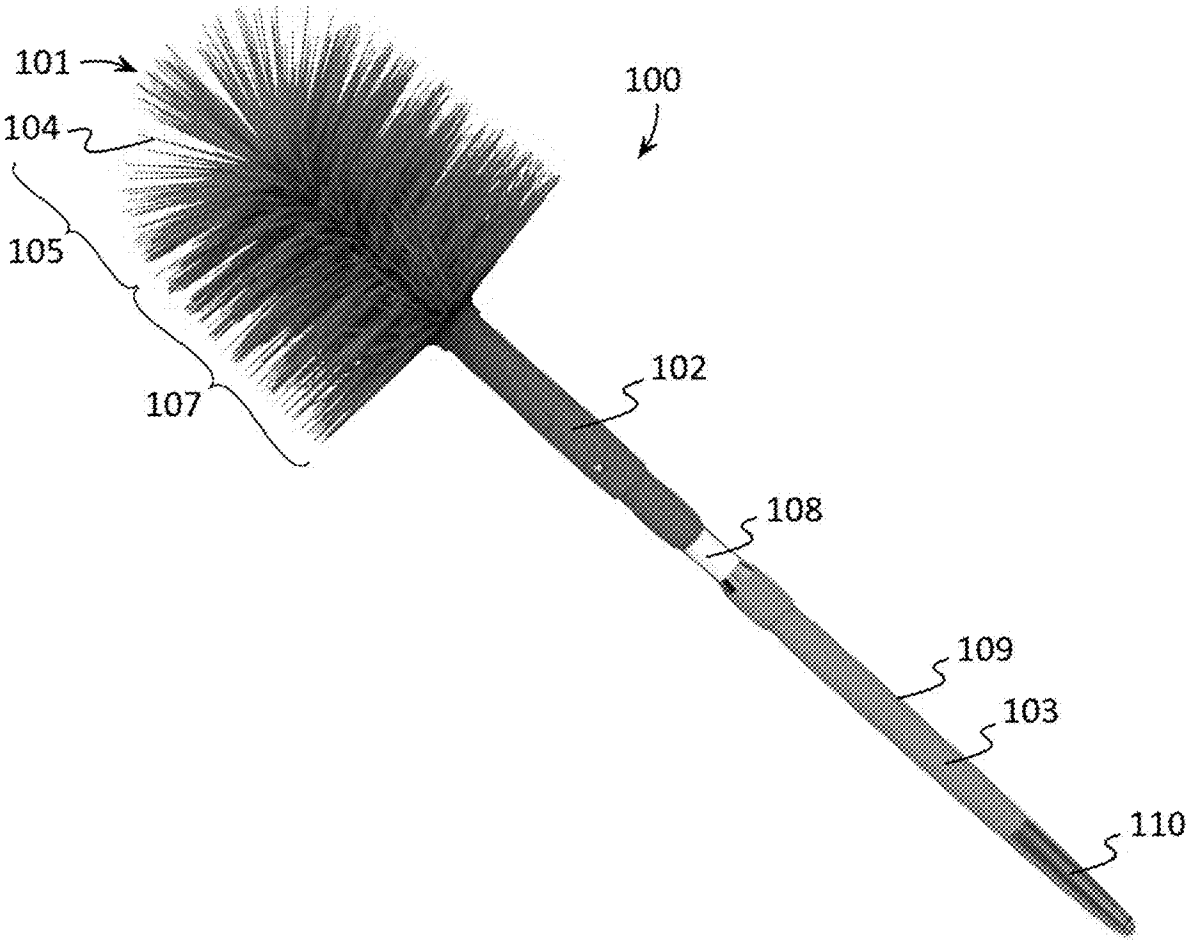
FIG. 1—FIG. 1 depicts a perspective view of an example of a multi-surface cleaning brush according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new multi-surface cleaning brush is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIG. 1 illustrates an example of a multi-surface cleaning brush ("the brush") 100 according to various embodiments. In some embodiments, the brush 100 may comprise a head portion 101, an optional tail portion 103, and an optional handle 102. The head portion 101 and tail portion 103 may be coupled to opposing ends of the handle 102. The head portion 101 may comprise a plurality of bristles 104 which may be coupled to a head 106 so that they may extend away from the head 106 to form the shape of the head portion 101. The bristles 104 may comprise a flexible material, such as microfiber. The head portion 101 may comprise a hemi-spheroid region 105 which may be formed by a plurality of bristles 104 which may terminate distally from the head 106 to form a generally hemi-spheroid shape which may be positioned distally to the handle 102. The head portion 101 may also comprise a radial region 107 which may be formed by a plurality of bristles 104 which may terminate distally from the head 106 to form a generally cylindrical shape which may be positioned between the hemi-spheroid region 105 and the handle 102.

The brush 100 may comprise a head portion 101 which may include a plurality of bristles 104 which may be coupled to a head 106. Generally, the head 106 may comprise the portion of the head portion 101 that bristles 104 may be coupled to, and the head 106 may be configured in any shape and size. A head 106 may be made from or may comprise substantially rigid materials, such as metal and metal alloys, hard plastics, including polyethylene (PE), Ultra-high-molecular-weight polyethylene (UHMWPE, UHMW), polypropylene (PP) and polyvinyl chloride (PVC), polycarbonate, nylon, hard rubbers, wood, other plant based materials; cushioning materials, such as silicone foams, rubber foams, urethane foams including plastic foams, neoprene foam, latex foam rubber, polyurethane foam rubber, or elastomer materials such as elastic plastics, elastic silicone, elastic rubbers; and/or any other material including combinations of materials.

The brush 100 may comprise a plurality of bristles 104 which may be configured in any size and shape to form the shape of the hemi-spheroid region 105 and the shape of the radial region 107. In some embodiments, one or more bristles 104 may extend away from the head 106 a distance (length distance) of approximately 2.0 to 10.0 inches.

Figure 2:
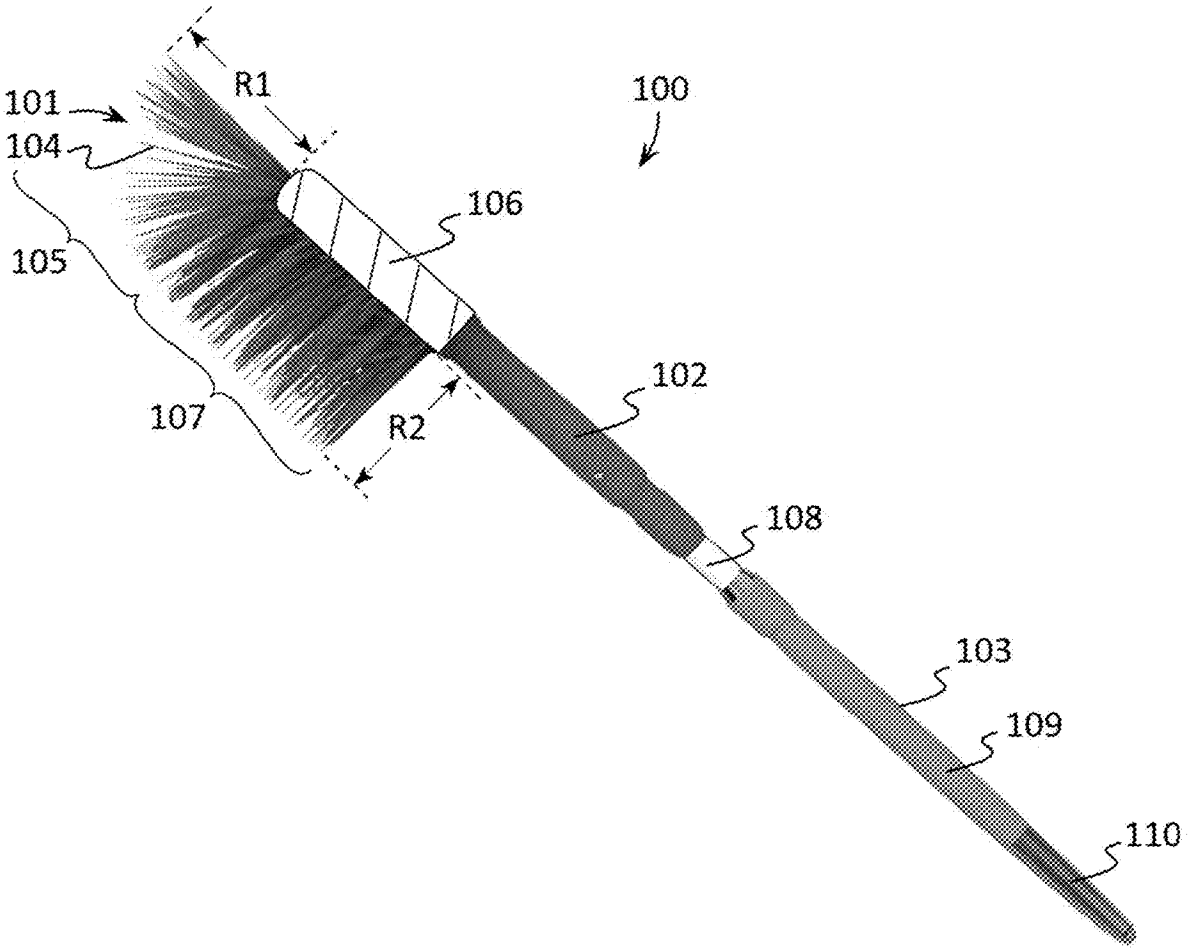
FIG. 2—FIG. 2 illustrates a perspective, partial sectional view of an example of a multi-surface cleaning brush according to various embodiments described herein.

The head portion 101 may comprise a hemi-spheroid region 105 which may be formed by a plurality of bristles 104 which may terminate distally from the head 106 to form a generally hemi-spheroid shape which may be positioned distally to the handle 102. A spheroid may be a solid generated by a half-revolution of an ellipse about its major axis (prolate spheroid) or minor axis (oblate spheroid), and a hemi-spheroid may be a section, such as half, of a spheroid shape. In preferred embodiments, the bristles 104 forming the hemi-spheroid region 105 may be configured with a length distance which allows the hemi-spheroid region 105 to have approximately a 4.0 to 10.0 inch radius (R1 as shown in FIG. 2), and more preferably approximately a 6.0 to 8.0 inch radius (R1 as shown in FIG. 2).

The head portion 101 may comprise a radial region 107 which may be formed by a plurality of bristles 104 which may terminate distally from the head 106 to form a generally cylindrical shape which may be positioned between the hemi-spheroid region 105 and the handle 102. In preferred embodiments, a radial region 107 may comprise a cylindrical shape having substantially straight parallel sides and a circular or oval cross section. In further embodiments, a radial region 107 may comprise a generally cylindrical shape formed from a section of a cone having substantially straight sides angled relative to each other and a circular or oval cross section. In preferred embodiments, the bristles 104 forming the radial region 107 may be configured with a length distance which allows the radial region 107 to have approximately a 4.0 to 10.0 inch radius (R2 as shown in FIG. 2), and more preferably approximately a 6.0 to 8.0 inch radius (R2 as shown in FIG. 2).

A head portion 101 may be configured in any size and shape. In preferred embodiments, a head portion 101, having a hemi-spheroid region 105 and a radial region 107 may, comprise a length (defined by the distance between the portions of the bristle(s) 104 most proximate to the handle 102 and the portions of the bristle(s) 104 farthest from the handle 102) of approximately a 5.0 to 9.0 inches, and more preferably approximately a 6.0 to 8.0 inches.

The bristles 104 of the brush 100 may be made from or comprise one or more flexible materials. In some embodiments, all the bristles 104 of the brush 100 may be made from or comprise the same flexible material(s). In other embodiments, one or more of the bristles 104 of the brush 100 may be made from or comprise different flexible material(s).

In preferred embodiments, bristles 104 of the brush 100 may be made from or comprise a flexible material that may be microfiber. Microfiber (or microfibre) is synthetic fiber finer than one denier or decitex/thread, having a diameter of less than ten micrometers. Any type of microfibers may be used, such as microfibers made from polyesters, polyamides (e.g., nylon, Kevlar, Nomex, trogamide), or a conjugation of polyester, polyamide, and polypropylene.

In further embodiments, bristles 104 of the brush 100 may be made from or comprise synthetic materials such as strands or lengths of nylon, polyester, peek, polyethylene, polypropylene, polystyrene, polytetrafluoroethylene (PTFE), polyvinyl chloride (PVC), any other synthetic bristle material, and/or natural materials such as strands or lengths of goat hair, hog bristle, horsehair, camel hair, ox hair, sable hair, skunk or fitch, squirrel, bass or piassava, bassine, kittool, palmetto, palmyra, rice root, tampico, union fiber, or any natural bristle material including metals and metal alloys. Any suitable coupling method may be used to couple the bristles 104 to the head 106.

The brush 100 may comprise an optional handle 102 which may be coupled to the head 106 and to the tail portion 103. In some embodiments, a handle 102 may be removably coupled to the head 106 and/or to the tail portion 103. A handle 102 may be configured in any shape and size. A handle 102 may be configured as a hand grip for the brush 101, which may be ergonomically shaped so that the user's hand may grip the brush 100 via the handle 102 and tail portion 103. In some embodiments, a handle 102 may comprise a generally elongated and more preferably a generally cylindrical shape. A handle 102 may be made from or may comprise substantially rigid materials, cushioning materials, and/or any other material including combinations of materials.

The brush 100 may comprise a tail portion 103 which may serve to increase the amount of the brush 100 that may be held and manipulated by a user. A tail portion 103 may be configured in any shape and size. In some embodiments, a tail portion 103 may comprise a generally elongated and more preferably a generally cylindrical shape. In further embodiments, a tail portion 103 may comprise a tail 110 which may form the portions of the tail portion 103 that may be distal to the head portion 101 and handle 102, and preferably the tail 110 may comprise a cone shape for enabling convenient handling of the cleaning brush 100. A tail portion 103 may be made from or may comprise substantially rigid materials, cushioning materials, and/or any other material including combinations of materials.

In some embodiments, a tail portion 103 may comprise a fixed length, while in preferred embodiments; a tail portion 103 may comprise an adjustable length so that the tail portion 103 may be moved into and between a relatively longer length and a relatively short length. For example, a tail portion 103 may be extendable into and between a length of 8.0 inches and a length of 65.0 inches.

In preferred embodiments, an adjustable length tail portion 103 may comprise one or more minor tail sections 108 which may be retracted into and extended out of one or more major tail sections 109 in a telescoping manner. In other embodiments, an adjustable length tail portion 103 may comprise one or more tail sections 108, 109, which may be removably coupled together to form a tail portion 103 having various lengths. For example, by coupling three tail sections 108, 109, together a relatively shorter length tail portion 103 may be formed than a tail portion 103 having four or more tail sections 108, 109.

In preferred embodiments, the brush 100 may comprise bristles 104 made from ultra-absorbent microfiber which may be used to clean the multiple surfaces of objects, such as automobiles, without creating any scratch and damage to the surface. The ultra-absorbent microfiber bristles 104 may be soft and made of noodle style microfiber which gives deep and perfect cleaning of surfaces. The ultra-absorbent microfiber may be highly flexible and spongy which gives high absorption of dirt and liquids. Use of the brush 100 for cleaning of vehicle surfaces also protects and prevents staining, fading, discoloration and premature ageing of vehicle surface.

In preferred embodiments, the brush 100 may be manipulated for rotary cleaning of automobiles and may be used for cleaning of every part of the automobile such as penetrate areas (tight in dimension), including wheel, grills, bumper and window, and in between parts of the vehicle.

It should be understood that the brush 100 may be used to clean any object, including but not limited to vehicles, such as car, truck, motorbike, SUVs, RVs boats and any other available vehicle types.

While some exemplary shapes and sizes have been provided for elements of the brush 100, it should be understood to one of ordinary skill in the art that the head portion 101, handle 102, tail portion 103, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the brush 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the brush 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the brush 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the brush 100 may be coupled by being one of connected to and integrally formed with another element of the brush 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A multi-surface cleaning brush, the brush comprising:

a head and a handle, the head comprising (i) a hemi-spheroid shaped regions, and (ii) a substantially cylindrical shaped radial region located between the hemi-spheroid shaped regions and the handle, a first plurality of bristles coupled to the hemi-spheroid shaped region and defining a hemi-spheroid brushing portion and a second plurality of bristles coupled to the radial region and defining a substantially cylindrical brushing portion; and wherein the first plurality of bristles coupled to the hemi-spheroid shaped region have a first length (R1) between 6 to 8 inches and the second plurality of bristles coupled to the radial region have a second length (R2) between 6 to 8 inches.

2. The brush of claim 1, wherein the first plurality of bristles comprise microfiber.

3. The brush of claim 1, wherein the second plurality of bristles comprise microfiber.

4. The brush of claim 1, further comprising a tail portion coupled to the handle.

5. The brush of claim 4, wherein the tail portion is removably coupled to the handle.

6. The brush of claim 4, wherein the tail portion comprises a cone-shaped tail.

* * * * *